United States Patent [19]

Slattery

[11] 4,384,538

[45] May 24, 1983

[54] TUFTING MACHINE

[75] Inventor: Ian Slattery, Hixson, Tenn.

[73] Assignee: Spencer Wright Industries, Inc., Chattanooga, Tenn.

[21] Appl. No.: 294,458

[22] Filed: Aug. 20, 1981

[51] Int. Cl.[3] ..... D05C 15/00

[52] U.S. Cl. ..... 112/79 R

[58] Field of Search ..... 112/79, 79 A, 79 FS

[56] References Cited

U.S. PATENT DOCUMENTS

| | | | |
|---|---|---|---|
| 3,064,600 | 11/1962 | Card | 112/79 R |
| 4,193,359 | 3/1980 | Beasley | 112/79 R |
| 4,303,025 | 12/1981 | Bardsley | 112/79 R |

*Primary Examiner*—Ronald Feldbaum

*Attorney, Agent, or Firm*—Alan Ruderman

[57] ABSTRACT

A staggered needle cut pile tufting machine having needle plate backing support fingers oscillated in timed relationship with the hooks and the needles of the machine to support the backing material during needle penetration and to withdraw from the needle path as the hooks move across the needle path to seize respective loops. The support fingers are substantially straight parallel members with alternate fingers being elongated relatively to the remaining fingers so that the fingers provide support of the backing material adjacent the penetration points of the respective staggered needles in the front and rear rows. The straight parallel fingers provide clearance for the needle plate to be withdrawn from the needle array so that a path is provided for the hooks to be closely adjacent the backing material for forming very low fine gauge cut pile fabrics. The fingers are mounted in a modular block member within which they are cast, the modules being mounted on a rocker arm carried by a common rock shaft with the rocker arm on which the hooks are mounted so that the fingers oscillate in opposition to the oscillation of the hooks.

5 Claims, 4 Drawing Figures

TUFTING MACHINE

BACKGROUND OF THE INVENTION

This invention relates to tufting machines and more particularly to cut pile staggered needle tufting machines for producing very low pile height cut pile fabrics.

In copending U.S. patent application Ser. No. 212,316 filed Dec. 3, 1980, now U.S. Pat. No. 4,303,025 a cut pile tufting machine is disclosed in which the needle plate fingers are oscillated in timed relationship with the hooks and needles to support the backing material during needle penetration and to withdraw from the plane of needle reciprocation as the hooks move across the needles to seize loops of yarn therefrom. By providing for the withdrawal of the needle plate fingers from the path of movement of the needles after the fingers have fulfilled their function of supporting the backing material during penetration, a path of movement for the hooks which lies at or closely adjacent to the opposing face of the backing material is made available so that the underside of the bill of the hook, which is the cutting edge for the cut pile blade, is closely adjacent to the underside of the backing material. Thus, very low pile fabric can be produced.

In apparatus disclosed in the aforesaid application all of the needles lie in a common vertical plane and thus so too do the points of the hooks which cooperate therewith. For this reason all of the needle plate fingers are aligned. However, for a narrow gauge machine, because of space limitations it becomes necessary for the needles to be divided into spaced rows with the needles in each row staggered relatively to the needles in the other row. In this case the hooks must have bills which are likewise staggered so that the hooks cooperate with the respective needles in the different rows. Moreover, in order for the needle plate fingers to perform their intended function of supporting the backing material during penetration by the needles, the fingers must have a configuration for providing support adjacent the penetration points of all the needles.

Prior art close gauge staggered needle machines, to provide the required backing fabric support, provided needle plate fingers of various configurations. For example, in U.S. Pat. No. 3,492,956, the fingers have double off set portions intermediate their length with adjacent fingers alternately oriented in opposite dispositions so that the off sets are disposed about the needles in the row remote from the needle plate. In U.S. Pat. No. 3,064,600, the fingers have double off set portions adjacent the needle plate and are alternately oriented so that the off sets are disposed about the needles in the row adjacent the needle plate. In U.S. Pat. No. 2,976,829, the fingers have single off set portions which are oriented so that the off sets are disposed about the needles in the row adjacent the needle plate. In another arrangement fingers having single off set portions are disposed so that alternate pairs of fingers extend to form a "Y" configuration and the needles in the row remote from the needle plate are disposed within the fork of the "Y".

In each of these constructions the spacing between adjacent fingers of alternate pairs at the needle row remote from the needle plate (hereafter back row) is narrower than the thickness of the needles in the row adjacent the needle plate (hereafter front row), this being especially due to the inclination of the needles in the needle bar. Thus, the prior art needle plate finger constructions cannot be withdrawn from the path of movement of the needles for providing the required path for the hooks to be closely adjacent the backing material. Consequently, the prior art finger constructions are not capable of providing very low pile height when the needle gauge is narrow, i.e. in the order of 1/10 inch and narrower.

SUMMARY OF THE INVENTION

Consequently, it is the primary object of the present invention to provide apparatus for retaining a very low pile height fabric on a staggered needle cut pile tufting machine by withdrawal of the needle plate fingers from the needle path subsequent needle penetration of the backing material.

It is another object of the present invention to provide a staggered needle cut pile tufting machine having backing material support fingers which withdraw from between the needles as the hooks enter the loop seizing position with the needles.

It is a further object of the present invention to provide a needle plate finger construction for a staggered needle cut pile tufting machine capable of supporting the base material during needle penetration and withdrawing from the needle path as the hooks move toward loop seizing engagement with the needles.

In accordance with the principles of the invention the backing material support fingers for a staggered needle cut pile tufting machine are simple straight fingers which are moved out of the path of movement of the hooks as the hooks move to loop seizing disposition with the needle subsequent to penetration of the base material by the needle, alternate fingers being elongated to provide support of the fabric adjacent penetration points of the needles in the front and rear rows. The use of straight fingers of alternate lengths provide the required clearance allowing for the withdrawal of the needle fingers from the needle path thereby providing the path required for the hooks to be closely adjacent the backing material so that very low pile height fine gauge products can be tufted. Moreover, the utilization of alternate length straight fingers allows the fingers to be laterally as close to the paths of the hooks as geometrically possible. By providing the fingers in modular blocks mounted laterally across the machine the tolerances can be controlled to provide the required spacing.

BRIEF DESCRIPTION OF THE DRAWING

The particular features and advantages of the invention as well as other objects will become apparent from the following description taken in conjunction with the following drawings in which.

DESCRIPTION OF THE PREFERRED EMBODIMENT

Figure 1:
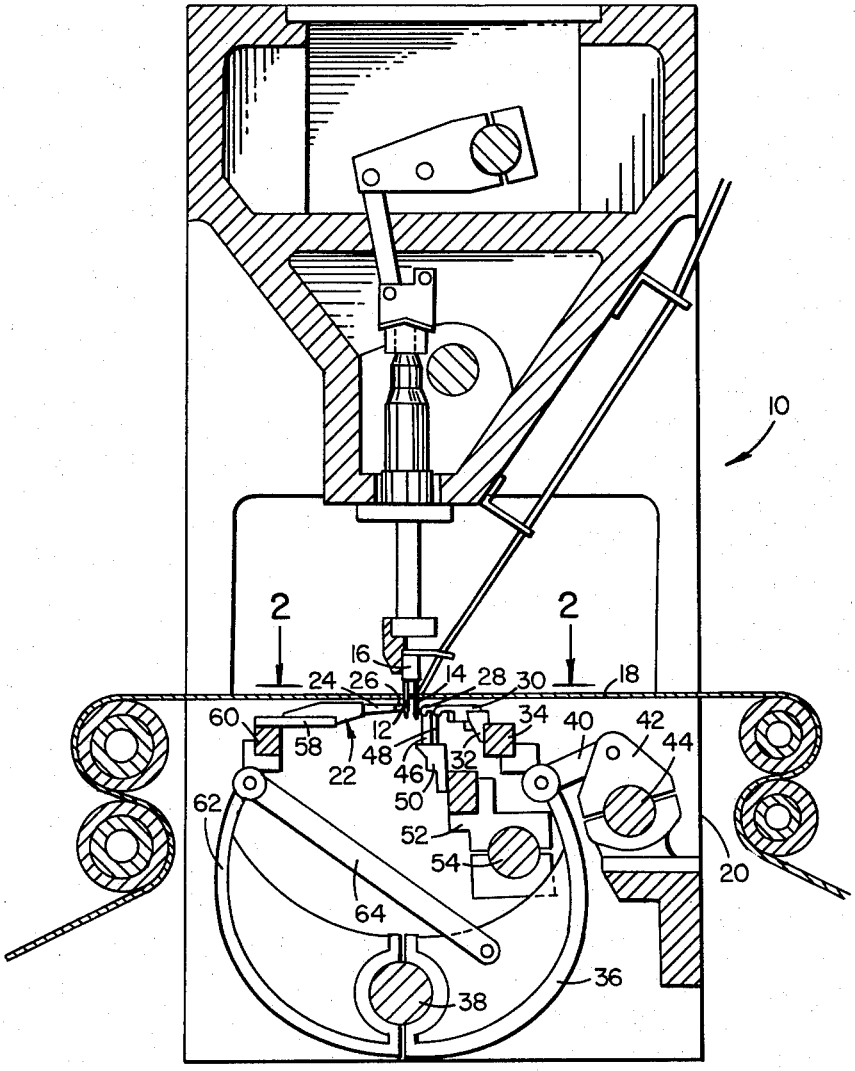
FIG. 1 is a cross-sectional view taken substantially vertically through the bed of a tufting machine incorporating the principles of the present invention.

Referring now to the drawings, the tuft-forming instrumentalities of a staggered needle cut pile tufting machine 10 comprises a multiplicity of front needles 12 and rear needles 14 mounted in a needle bar 16 reciprocably driven relatively to a backing material 18 through which the needles penetrate during each cycle of the machine. The backing material 18 is fed in the direction illustrated by the arrow across the bed 20 of the tufting machine, being supported on a needle plate 22 carrying a plurality of fingers 24, 26 during needle penetration, the needles 12, 14 passing during penetration between respective fingers 24, 26 extending from the needle plate in the direction of backing material feed. After penetration of the backing material the needles cooperate with respective oscillating hooks 28, 30 beneath the backing material which seize loops of yarn formed by the needles and hold the loops as the needles withdraw from the backing material.

The hooks 28, 30 may be conventionally mounted in hook bars 32 carried by a mounting bar 34 secured to the upper end of a rocker arm 36. Oscillation of the arm 36 may be conventionally provided by clamping the lower end of the arm to a laterally extending rock shaft 38 journalled in the bed 20 of the machine. A connecting link 40 pivotably connected to the upper portion of the rocker arm 36 at one end and pivotably connected to a jack shaft rocker arm 42 clamped to a jack shaft 44 oscillated by conventional means in timed relationship with the reciprocation of the needle bar, acts to drive the rocker arm 36.

A respective knife 46, 48 cooperates with each hook 28, 30 to cut loops of yarn seized and retained on such hook and moving rearwardly thereof into the path of movement of the knife as the backing material advances. The knives 46, 48 may be mounted in a knife block 50 secured on a rocker arm 52 clamped to an oscillating rocker shaft 54 driven in timed relationship with the reciprocation of the needle bar so as to provide a scissors-like cutting action between the knives and their respective hooks to form cut pile fabric.

Figure 2:
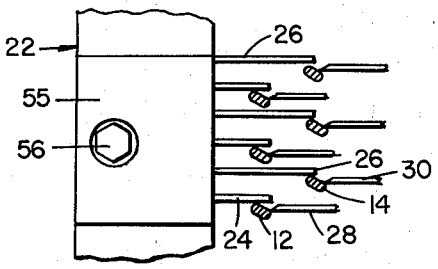
FIG. 2 is a horizontal cross-sectional view taken substantially along line 2—2 of FIG. 1.

With reference to FIG. 2, the needle plate 22 preferably comprises a plurality of needle finger modules 55, each module having a plurality of fingers 24, 26 mounted laterally therein. Each module includes mounting means such as a bolt 56 extending through the body of the module so as to be secured to an elongated plate 58. The fingers are cast or molded into the body of the module adjacent fingers 24, 26 being of alternate lengths, the fingers 26 as illustrated being longer than the fingers 24. The fingers 26 thereby support the backing material adjacent to the penetration points made by the rear row of needles 14, while the fingers 24 support the backing material adjacent to the penetration points made by the front row of needles 12.

In order to produce fabrics having exceptionally low pile heights the needle plate fingers support the backing material in the region of the needles only during needle penetration, the fingers being withdrawn from that region as the hooks 28, 30 move forward into cooperative engagement with the respective needles 12, 14. Thus, the needle plate 22 is mounted for reciprocable motion toward and away from the plane of the axes of the needles in synchronism with the cyclic movement of the needles and hooks. The forwardly extending fingers, which are in closely spaced relationship laterally with the respective hooks, are withdrawn from the path of the hooks as the hooks move into cooperative engagement with the needles. Moreover, the hooks 28, 30 are so positioned in relation to the backing material that the upper edges 59 thereof are approximate to the plane of the support surface of the needle plate fingers.

The plate 58 which carries the needle plate modules is supported on a bar 60 attached to the upper end of a rocker arm 62. The rocker arm 62 is driven in timed relationship with the rocker arm 36, which in the preferred embodiment is attained by clamping the lower end of the rocker arm 62 to the rock shaft 38. To ensure a positive drive connection between the rocker arms 38 and 62, a link 64 may be provided rigidly connecting the two rocker arms together. Thus, as the rocker arm 36 oscillates forwardly so to does the rocker arm 62.

Figure 3:
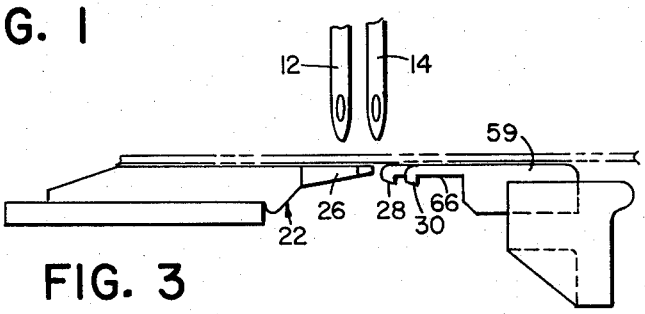
FIG. 3 is a diagrammatic side elevational view of a portion of the tuft forming instrumentalities of the tufting machine of FIG. 1, illustrating the parts just prior to needle penetration of the base material.
Figure 4:
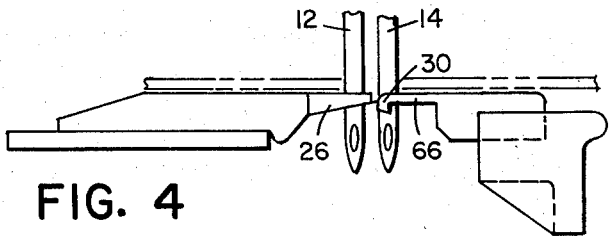
FIG. 4 is a view similar to FIG. 3 illustrating the parts in the loop seizing position.

Referring to FIGS. 3 and 4 it will be understood that as the needles 12 and 14 reciprocate downwardly for penetration into the backing material the needle plate 22 together with the fingers 24, 26 are in a disposition such that the fingers are disposed in the plane of needle reciprocation to support the backing material as the needles penetrate therethrough. However, as the hooks 28, 30 oscillate toward loop seizing engagement with the respective needles 12, 14 the needle plate together with the fingers 24, 26 oscillate away from the plane of needle reciprocation as illustrated in FIG. 4. In view of the fact that the fingers 24, 26 are straight and parallel to each other the fingers can be withdrawn from the needle array. This was not possible with the needle plate fingers of the staggered needle cut pile prior art tufting machines. Because alternate fingers 26 are elongated relatively to the fingers 24, proper backing material support is provided by all of the fingers relatively to the penetration points of the respective needles.

As should be readily appreciated, a very low pile height is attainable with very close gauge between the tufting instrumentalities. The minimum pile height, which is determined by the spacing of the cutting edge 66 of the hooks 28, 30 from the backing material, is with the proposed construction made independent of the geometry of the needle plate fingers. Thus, the invention is particularly applicable in the context of very fine gauge low pile fabric such as upholstery fabrics.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. In a tufting machine including means for supporting a backing fabric moving in one direction, first and second rows of yarn carrying needles supported on one side of said backing material, each row having a plurality of laterally spaced needles, the needles in one row being spaced from the needles in the other row in the direction of movement of said backing and the needles of one row being laterally staggered relatively to the needles in the other row, means for reciprocating the needles for penetrating the backing material and forming loops therein, first and second rows of hooks supported on the opposite side of said backing material from said needles, there being one hook corresponding to and cooperating with each needle, means for oscillating said hooks toward and away from the path of the respective needle in timed relationship with the reciprocation for ceasing said loops in succession, a knife cooperating with each hook for severing loops on said hooks in succession, said means for supporting said backing material comprising a plurality of laterally spaced fingers, each of said fingers being of substantially straight members having a free end extending in the direction of movement of said backing material, the spacing between adjacent fingers accommodating said needles, alternate fingers being of a first length for supporting said material adjacent the penetration of said first needles, remaining fingers being of a second length differing from said first length substantially by the spacing between the needle rows for supporting said material adjacent the penetration of said second needles, and means for oscillating said fingers in timed relationship to said hooks from a disposition in the path of reciprocation of respective needles for supporting said material during penetration thereof to a disposition withdrawn from said path as said hooks move toward said path.

2. In a tufting machine as recited in claim 1, wherein a plurality of said fingers are fixedly cast in a modular body member, and said means for oscillating said fingers comprises means for oscillating said body member.

3. In a tufting machine as recited in claim 1 or 2, wherein said means for oscillating said hooks includes means for oscillating said fingers.

4. In a tufting machine as recited in claim 1, wherein each of said hooks comprise a bill for holding a seized loop to be cut, said bill having an upper surface disposed during loop seizure in substantially the same plane as the plane of backing material support of said fingers.

5. In a tufting machine as recited in claim 4, wherein each of said fingers is in substantially the same lateral plane as respective hook.

* * * * *